United States Patent [19]

Laverty

[11] 4,122,980

[45] Oct. 31, 1978

[54] CONTAINER TOP WITH INTEGRAL STOPPER

[75] Inventor: Gerald C. Laverty, Santa Clara, Calif.

[73] Assignee: Gary J. Mastman, San Jose, Calif.

[21] Appl. No.: 819,033

[22] Filed: Jul. 25, 1977

[51] Int. Cl.[2] ..... B65D 41/34

[52] U.S. Cl. ..... 222/207; 215/253; 222/541

[58] Field of Search ..... 222/541, 207; 215/250, 215/253; 220/276

[56] References Cited

U.S. PATENT DOCUMENTS

| | | | |
|---|---|---|---|
| 1,080,747 | 12/1913 | Buckley | 220/276 |
| 2,742,202 | 4/1956 | Dresden | 222/541 |
| 2,750,068 | 6/1956 | Platt | 222/541 X |
| 3,124,280 | 3/1964 | Stull | 222/541 |

FOREIGN PATENT DOCUMENTS

| | | | |
|---|---|---|---|
| 1,220,045 | 1/1960 | France | 222/541 |
| 1,392,963 | 2/1965 | France | 222/541 |
| 347,605 | 8/1960 | Switzerland | 220/265 |

*Primary Examiner*—Donald F. Norton
*Attorney, Agent, or Firm*—Townsend and Townsend

[57] ABSTRACT

A top for attachment to the neck opening of a container, wherein the top has a lower extremity provided with a passage therethrough. The top is molded from a suitable plastic material and has a stopper integral therewith in alignment with the passage at one end thereof. A line of weakness between the top and the stopper allows the stopper to be manually shifted back and forth and broken away from the top. The stopper can then be inverted into the passage to provide a removable stopper for closing the passage.

2 Claims, 4 Drawing Figures

FIG. 1
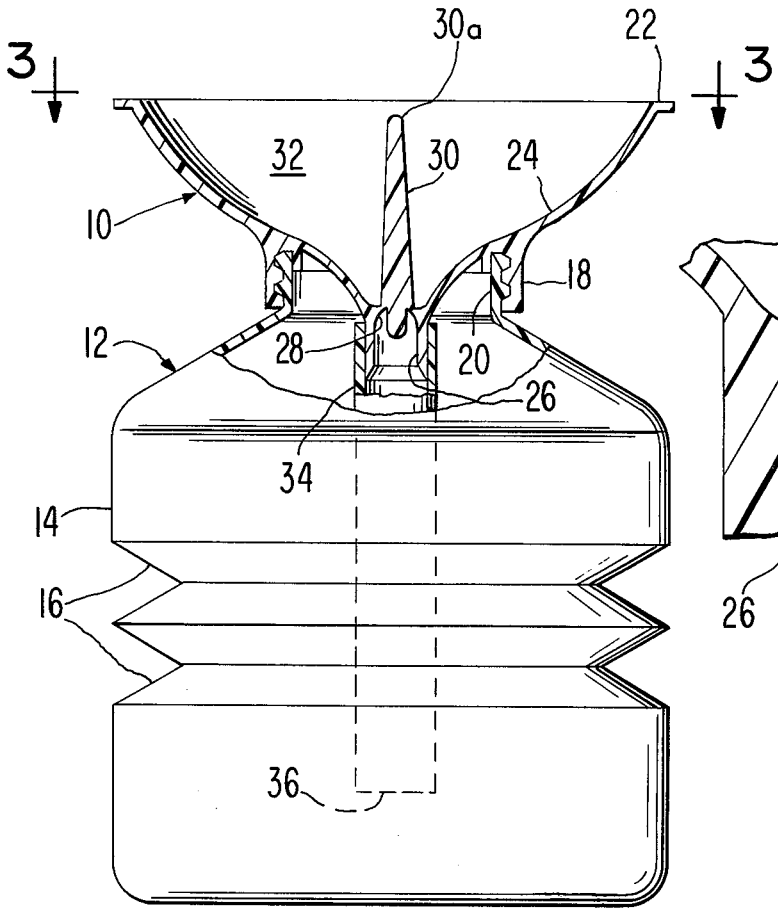
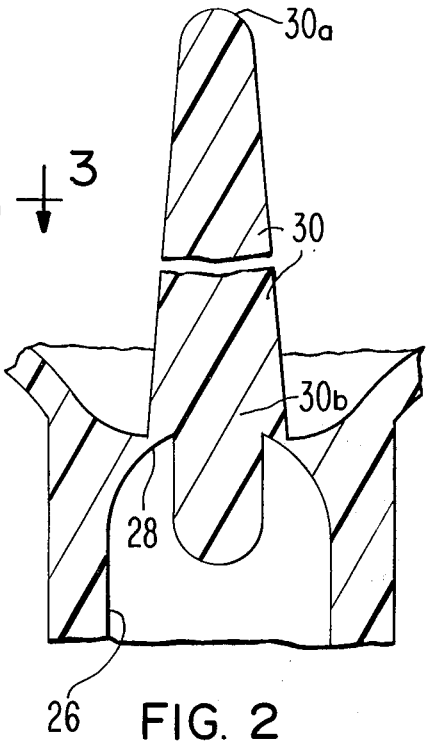
FIG. 2
FIG. 3
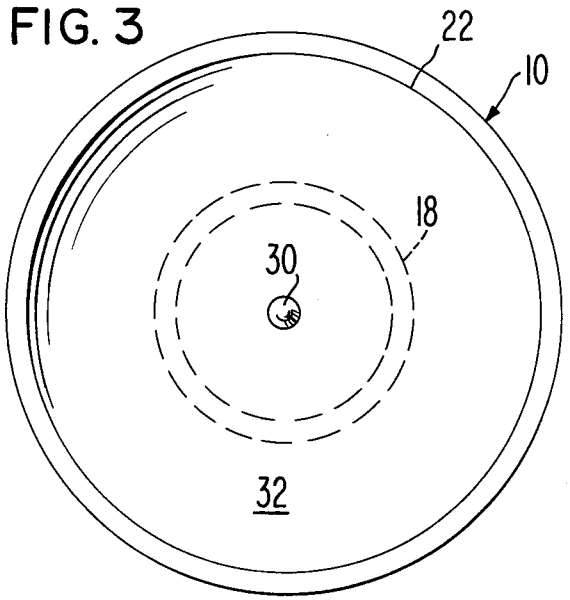
FIG. 4
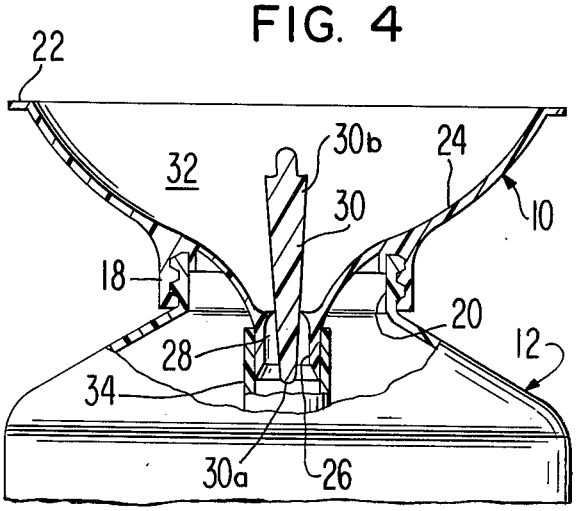

CONTAINER TOP WITH INTEGRAL STOPPER

This invention relates to improvements in container tops of the type for dispensing liquids and other materials and, more particularly, to a top of moldable material.

BACKGROUND OF THE INVENTION

It has been found practical to make a liquid dispenser suitable for use with liquid soaps, lotions and the like by providing a container having a corrugated sidewall and a funnel-shaped top for covering the neck opening of the container so that, when the sidewall of the container is collapsed by downward pressure on the top, the liquid will spurt upwardly from the container and through a passage in the lower extremity of the top. If the palm of the hand is used to exert the downward force, the liquid will engage the palm and a part of the liquid will stay on the palm by surface tension. The liquid on the palm can then be used in a particular manner, such as for washing the hands or for applying lotion to the face or body.

In shipment and storage of the dispenser, it is desirable to plug the passage in the lower extremity of the top to prevent evaporation of the contents of the container or the entrance of foreign matter into the container. A need has, therefore, arisen for a simple stopper to accomplish this purpose.

SUMMARY OF THE INVENTION

The present invention is directed to an improved top for a liquid dispenser, wherein the top has a hole or fluid passage therethrough for communicating with the container. A stopper is molded directly to the top in alignment with the hole or passage to cover or block the same. The stopper can be broken off the top to open the hole or passage, yet the shape of the stopper allows it to be inverted and to be inserted into the hole or passage and thereby removably close or block the same.

To this end, the stopper comprises a sprue formed on the top at the time the top is molded. The stopper has a taper and a maximum transverse dimension greater than that of the hole or passage. Thus, the stopper, when inserted in the hole or passage, projects upwardly therefrom to present a part that can be manually lifted out of the hole or passage and replaced thereon.

The primary object of this invention is to provide a molded top for a container, wherein the top has a hole or passage therethrough for communicating with the container and a tapered stopper integral with the top and in alignment with the hole or passage, so that the stopper can be broken off from the top and inserted in the hole or passage to close the same or block fluid flow therethrough.

Other objects of this invention will become apparent as the following specification progresses, reference being had to the accompanying drawing for an illustration of the invention.

IN THE DRAWINGS:

FIG. 1 is a side elevational view, partly in section, showing the container with the top of the present invention thereon, the stopper being integral with the top;

FIG. 2 is an enlarged, fragmentary, cross-sectional view of the top showing the way the stopper is integral therewith;

FIG. 3 is a top plan view of the top of FIG. 1; and

FIG. 4 is a view similar to FIG. 1, but showing the stopper separated from integral connection with the top and inserted to close the opening in the bottom of the top.

The embodiment of the container top of the present invention is broadly denoted by the numeral 10 and is shown in FIG. 1 on a container 12 having an open neck and a corrugated sidewall 14 provided with one or more corrugations 16 to permit collapse of the sidewall when a downward force is exerted on the upper end of the container. Top 10 has a skirt 18 connected to the neck 20 of the container. For purposes of illustration, skirt 18 and neck 20 are annular and are threadably connected to each other whereby the top can be removably coupled with the container. Also, for purposes of illustration, top 10 has a generally funnel shape and is provided with an upper annular rim or edge 22 surrounding an upper opening. Rim 22 can be engaged by the palm of the hand to permit a downward force to be exerted on the top and thereby the container to collapse sidewall 14.

Top 10 comprises a molded body having a downwardly sloping inner surface 24 throughout a major portion of the distance between rim 22 and a projection 28 near the lower extremity of top 10. A tubular segment 26 integral with top 10 extends downwardly from projection 28. A sprue 30 of the same material as top 10 is integrally connected to and extends upwardly from projection 28. The sprue is formed in the molding of top 10. The junction between the projection and the sprue defines a line of weakness to permit the sprue to be broken off from integral connection with projection 28 so as to open the upper end of segment 26 and allow communication between the space 32 above projection 28 within top 10 and a tube 34 which is press-fitted or otherwise secured to segment 26 and depends therefrom. The lower end 36 of the tube will normally be below the normal level of liquid in the container. When the sprue is broken off, a hole is formed at the inner periphery of projection 28.

Sprue 30 is tapered or conical so that its normally upper end **30*a* has a transverse dimension less than the lower end 30*b*. This permits the sprue to be used as a stopper in the manner shown in FIG. 4. In this case, the sprue is inverted and then inserted into the hole surrounded by projection 28. The taper on the sprue allows it to be inserted throughout a portion of its length until the sprue engages projection 28**, thereby closing the opening.

Top 10 and sprue 30 are molded in any suitable process, such as an injection molding process. In the molding process, sprue 30 is formed as an integral attachment to projection 28, the sprue having the taper formed thereon at the time of molding. Sprue 30 can remain attached as shown in FIG. 1 during storage of the top or during shipment to a point of use. When it is desired to use the container with top 10 on it, the sprue is manually shifted back and forth until it is broken off from projection 38, the break being such that the hole formed by the separation of the sprue has a maximum transverse dimension less than that of the sprue. In the inverted position of FIG. 4, the sprue closes the hole of the container since the sprue substantially uniformly engages projection 28. Typically, the cross section of the sprue and the inner periphery of the projection are substantially circular.

When it is desired to dispense the contents of the container, the sprue is removed from the position shown in FIG. 4 and a downward force is applied to top 10, such as placing the palm of the hand on rim 22. A downward force is then exerted on the top, causing sidewall 14 to collapse at least slightly to decrease the volume of the container. Liquid in the container will then be forced upwardly through the bottom open end 36 of tube 34, through the tube and then upwardly through segment 26 and the hole surrounded by projection 28. The liquid will continue upwardly and engage the palm of the hand which overlies the upper opening of top 10. After dispensing of the liquid, the sprue can be returned to the position of FIG. 2 to close the hole.

I claim:

1. A top for a container having a corrugated side wall and an open neck comprising: a funnel-shaped body of a moldable material, said body having a top opening, a passage therethrough centrally disposed at the bottom thereof, and means thereon for coupling the body to the neck of the container with the passage communicating with the container, the body having an inner surface provided with a downward slope extending throughout a major part of the distance between said top opening and the passage and terminating at the passage; and an elongated stopper having a tapered outer surface and being of said material, said stopper being integral at one end thereof with the body at the termination of said inner surface, in alignment with said passage, and extending upwardly therefrom with the upper end of the stopper being adjacent to and below said top opening, there being a line of weakness at the junction between the body and the stopper to permit the latter to be separated from the body when the stopper is shifted relative to the body, the stopper having a maximum transverse dimension greater than that of the passage, whereby the stopper, after being separated from the body, can be inverted and inserted into the passage to at least partially close the same.

2. A top as set forth in claim 1, wherein the stopper is in closing relationship to the passage when the stopper is integral with the body.

* * * * *